US006698855B1

(12) United States Patent
Huang

(10) Patent No.: US 6,698,855 B1
(45) Date of Patent: Mar. 2, 2004

(54) AUTOMATIC SPACING ADJUSTMENT MECHANISM OF CARTRIDGE

(75) Inventor: Yu-Feng Huang, Chia I (TW)

(73) Assignee: Lite-On Technology Corporation, Taipei (TW)

( * ) Notice: Subject to any disclaimer, the term of this patent is extended or adjusted under 35 U.S.C. 154(b) by 0 days.

(21) Appl. No.: 10/224,646

(22) Filed: Aug. 21, 2002

(51) Int. Cl.[7] ..... B41J 25/308

(52) U.S. Cl. ..... 347/8; 400/55

(58) Field of Search ..... 347/8, 14, 19, 347/37; 400/55, 59

(56) References Cited

U.S. PATENT DOCUMENTS 6,315,468 B2 * 11/2001 Kishida et al. ..... 347/8

* cited by examiner

*Primary Examiner*—Juanita Stephens
(74) *Attorney, Agent, or Firm*—Rosenberg, Klein & Lee

(57) ABSTRACT

An automatic spacing adjustment mechanism of cartridge, which utilizes an existing paper feed drive motor of a printer to adjust the distance from a cartridge of a print cartridge receiving seat of the printer to papers. The automatic spacing adjustment mechanism of cartridge includes a gear set and a lift unit. The gear set can be triggered to be in a mutual engaged state through motion of the print cartridge receiving seat to the utmost side. The gear set can be driven to rotate by the paper feed drive motor. The lift unit can be driven by the mutual engaged gear set to lift or lower the print cartridge receiving seat.

11 Claims, 6 Drawing Sheets

AUTOMATIC SPACING ADJUSTMENT MECHANISM OF CARTRIDGE

FIELD OF THE INVENTION

The present invention relates to an automatic spacing adjustment mechanism of printing cartridge and, more particularly, to a spacing adjustment mechanism, which directly utilizes an existing paper feed drive motor of a printer to adjust the distance from a cartridge to papers without the need of any extra motor.

BACKGROUND OF THE INVENTION

Because an inkjet printer prints on papers by means of ink spraying, the spacing between its inkjet head and the papers must be adjusted for different kinds of papers. For example, for common papers of A4 size, a small spacing must be used; while for envelops or business cards, a larger spacing must be used. Otherwise, the quality and effect of printing will be greatly deteriorated. For adjustment of spacing between the inkjet head and papers, there have been inkjet printers (e.g., those produced by the Canon or Epson company) in the market utilizing a manual rod to adjust the spacing. Although they can accomplish the object of adjusting the spacing, a user needs to poke the rod himself, resulting in much inconvenience in use. Besides, there have also been inkjet printers (e.g., those produced by the HP company) in the market utilizing a motor to adjust the spacing. Although the user needs not to adjust the spacing himself, it is necessary to add in an extra motor, resulting in increase of their weight. Moreover, the motor also greatly increases the cost of the inkjet printers.

Accordingly, the present invention aims to propose an automatic spacing adjustment mechanism of cartridge so as to resolve the problems in the prior art.

SUMMARY OF THE INVENTION

The primary object of the present invention is to provide an automatic spacing adjustment mechanism of cartridge, wherein an existing paper feed drive motor of a printer is utilized to perform adjustment of spacing. Therefore, it is not necessary to add in any extra motor so that the high cost of motor will not be added.

Another object of the present invention is to provide an automatic spacing adjustment mechanism of cartridge, wherein a sensor capable of detecting the kind of paper is matched to automate the action of spacing adjustment without manual operation of user, hence achieving much convenience in use.

To achieve the above objects, the present invention provides an automatic spacing adjustment mechanism of cartridge, which comprises a gear set and a lift unit. The gear set can be triggered to be in a mutual engaged state through motion of a print cartridge receiving seat of a printer to the utmost side. The gear set can be driven to rotate by an existing paper feed drive motor. The lift unit can be driven by the mutual engaged gear set to lift or lower the print cartridge receiving seat.

The various objects and advantages of the present invention will be more readily understood from the following detailed description when read in conjunction with the appended drawing, in which:

DETAILED DESCRIPTION OF THE PREFERRED EMBODIMENTS

Figure 1:
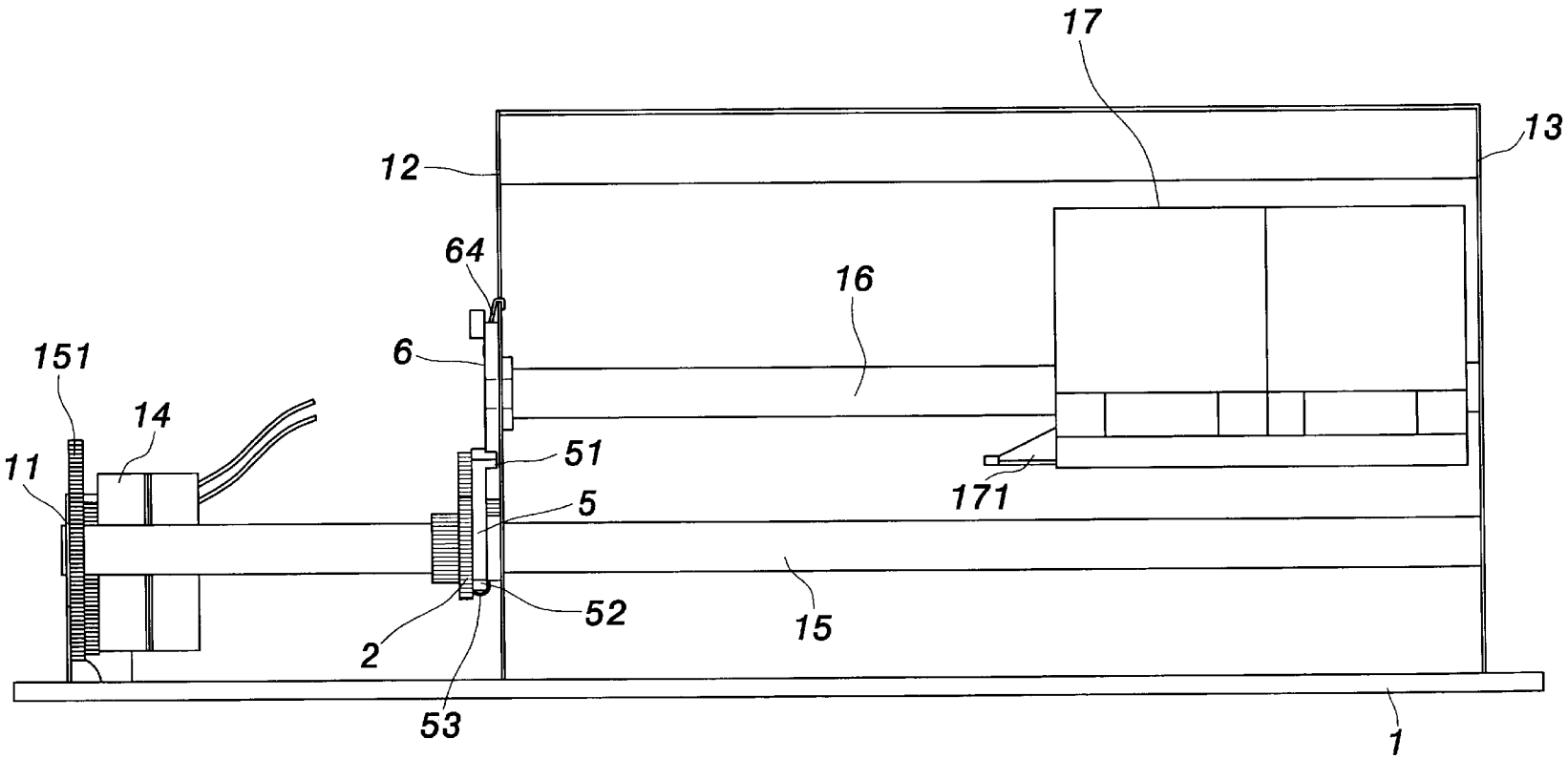
FIG. 1 is a front view of the present invention before action.

As shown in FIG. 1, the present invention provides an automatic spacing adjustment mechanism of cartridge, wherein a base 1 is a frame body composed of a first wall 11, a second wall 12, and a third wall 13. The first wall 11 has an existing paper feed drive component 14. A second pivotal rod 16 for transverse motion of a print cartridge receiving seat. 17 is disposed between the second and third walls 12 and 13. A first pivotal rod 15 driven by the paper feed drive motor 14 to achieve paper feed and exit function of the printer, is disposed between the first, second, and third walls 11, 12, and 13. The print cartridge receiving seat 17 for receiving a print cartridge (e.g., an ink box of an inkjet printer) is driven by a belt (not show) to move left and right for printing.

The paper feed drive component 14 drives the first pivotal rod 15 to rotate through a transmission gear 151.

Figure 2:
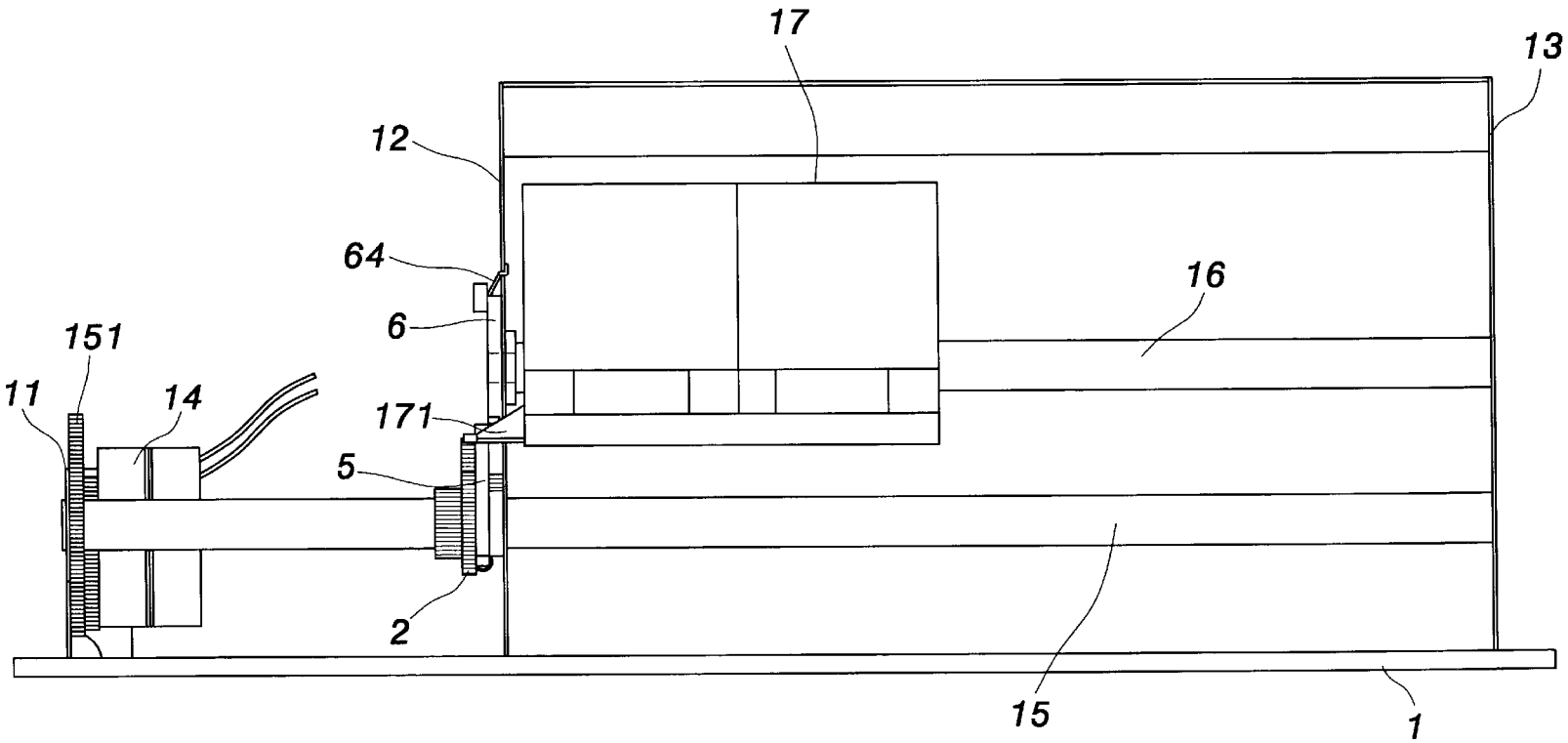
FIG. 2 is a front view of the present invention after action.
Figure 2A:
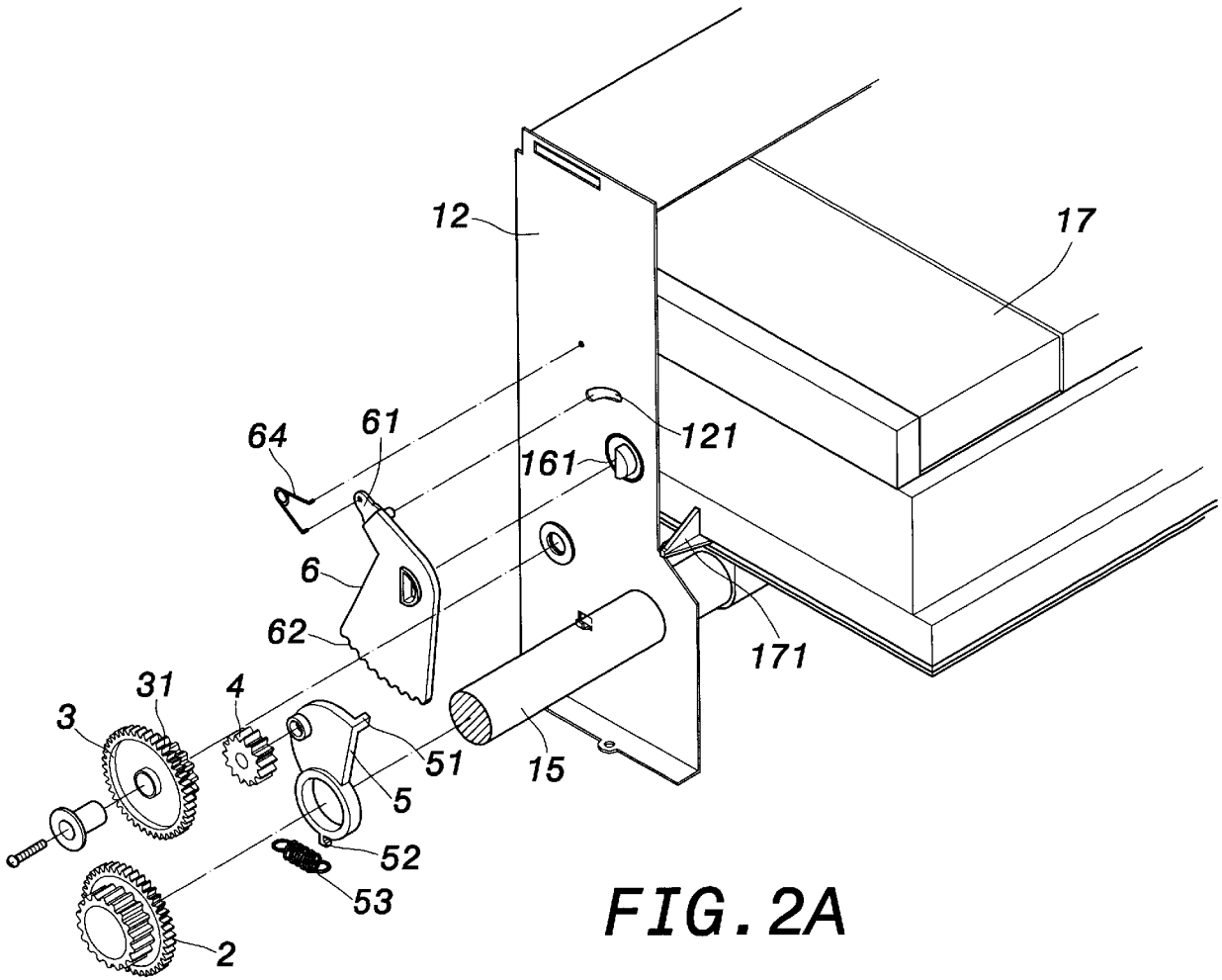
FIG. 2A is a partly exploded perspective view of the present invention.

As shown in FIGS. 1, 2, and 2A, a driving component 171 projects from beside the print cartridge receiving seat 17. A gear set comprising a first gear 2, a second gear 3, and a third gear 4 is disposed at the second wall 12. A lift unit comprising a second driven component 6 and a second pivotal rod 16 having eccentric cam function is also disposed at the second wall 12, as shown in FIG.

Figure 4:
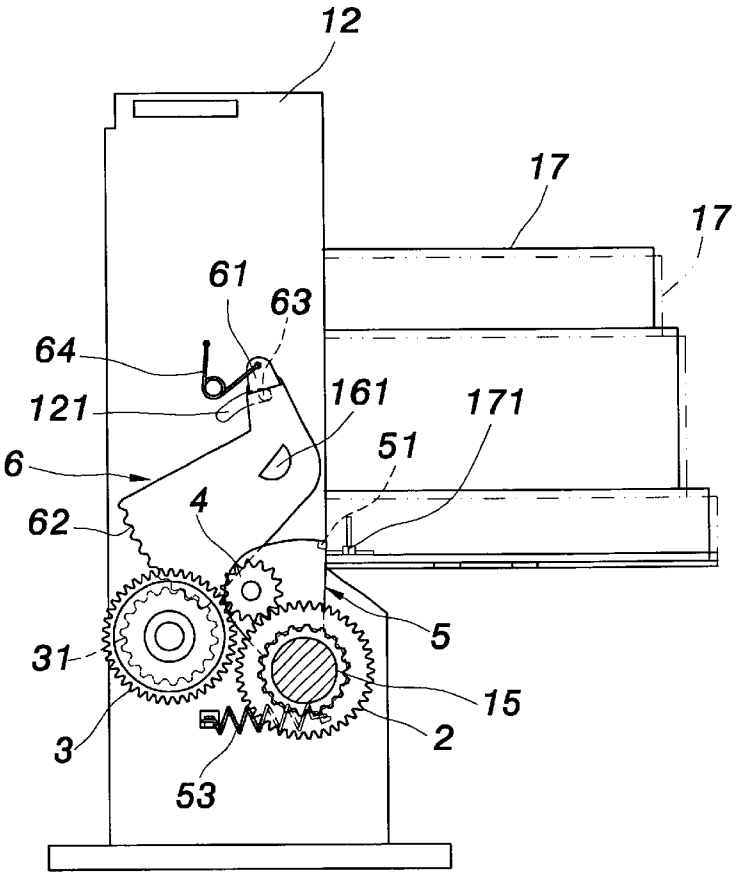
FIG. 4 is a partly left side view of the present invention after action.
Figure 3:
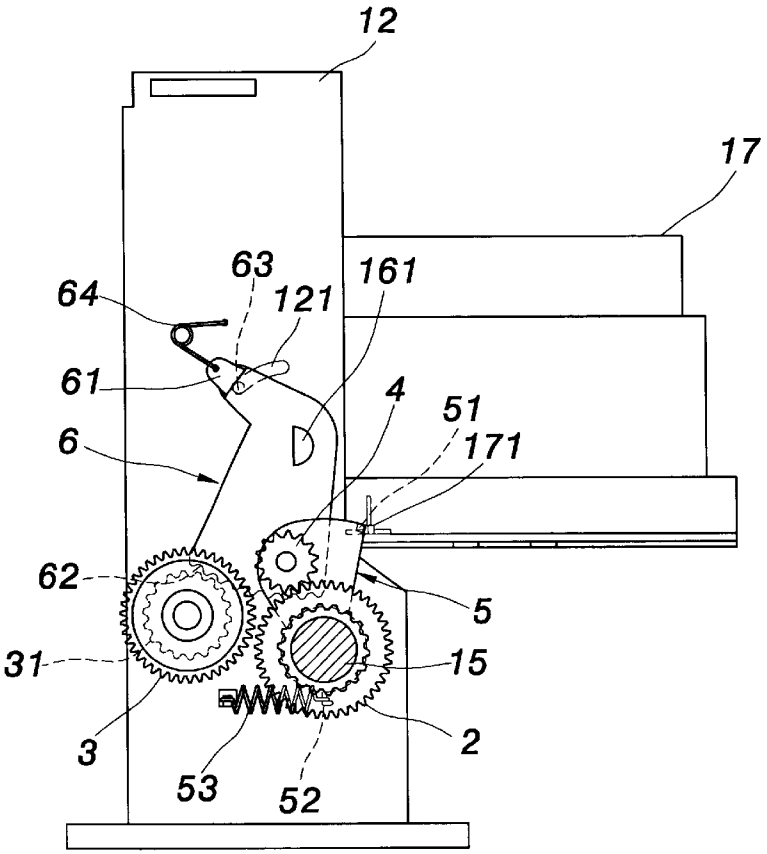
FIG. 3 is a partly left side view of the present invention before action.

Please refer to FIG. 3 with also reference to FIG. 1. The first pivotal rod 15 fixedly connects the first gear 2, and is movably slipped into a first driven component 5. The first driven component 5 is roughly of a fan shape, and is movably slipped onto the first pivotal rod 15 through the lower end thereof. A driven body 51 to be touched by the driving component 171 is formed at the front end of a fan edge of the upper end of the first driven component 5. The third gear 4 is pivotally connected at the rear end of the fan edge of the upper end of the first driven component 5. The first and third gears 2 and 4 engage each other. The third gear 4 can thus revolve around the periphery of the first gear 2 with the first pivotal rod 15 as the axis. The second gear 3 having a small diameter coaxial gear 31 is pivotally connected at the second wall 12, and is adjacent to but does not engage the first gear 2. As shown in FIG. 4, rotation of the second gear 3 lets the third gear 4 to further engage the second gear 3 through the first driven component 5 moving rearwards, thereby letting the gear set be in a mutual engaged state. Therefore, rotation of the paper feed drive motor 14 can be transmitted to the second gear 3, via the transmission gear 151, the first pivotal rod 15, the first gear 2, and the third gear 4.

As shown in FIGS. 1 and 2, when the print cartridge receiving seat 17 is driven by a belt to transversely move from a print region to a non-print region at the utmost side, the protrude driving component 171 will exactly drive the driven body 51 of the first driven component 5 to move rearwards a small distance so that the gear set can be in mutual engaged state as above. The second gear 3 will lead the lift unit to start acting.

Figure 7:
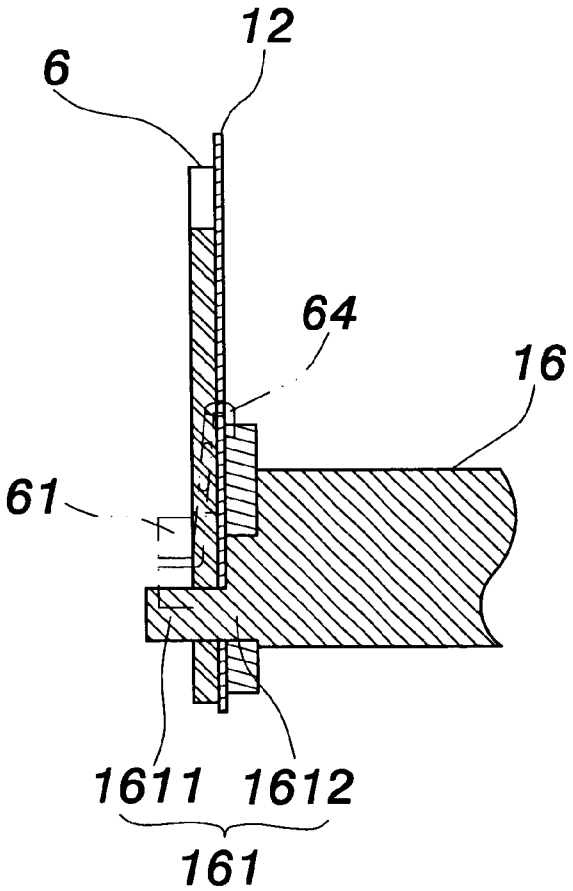
FIG. 7 is a cross-sectional view along line 7—7 shown in FIG. 5.

Please refer to FIG. 7 with also reference to the lift unit shown in FIG. 1. The second pivotal rod 16 is pivotally connected between the second wall 12 and the third wall 13 through eccentric shafts 161 at two ends thereof. The portion of the second pivotal rod 16 between the second and third walls is a large-diameter cylinder, the portion thereof pivotally connected in the wall is a small-diameter cylinder 1612, and the portion thereof protruding out of the second wall 12 and fixedly connecting the second driven component 6 is a small-diameter deformed post 1611 roughly of a semi-cylinder shape. The small-diameter deformed post 1611 is used as a basis to be driven by the second driven component 6. The large-diameter cylinder can make eccentric rotation with the small-diameter cylinder 1612 as the axis. The eccentric shaft 161 comprises the small-diameter deformed post 1611 and the small-diameter cylinder 1612.

Please refer to the lift unit shown in FIGS. 3 and 7. The center of the second driven component 6 roughly of a crank shape is fixedly connected with the small-diameter deformed post 1611 to lead the second pivotal rod 16 to rotate.

The second driven component 6 is roughly lying on the second wall 12. An arm body 61 extends from the upper end of the second driven component 6. A teeth edge 62 is formed at a fan edge of the lower end of the second driven component 6. A protrudent post 63 projects from near the upper end of the second driven components toward a trench 121 of the second wall 12. The protrudent post 63 can be guided by the arc-shaped trench 121. The teeth edge 62 of the second driven component 6 engages the coaxial gear 31 of the second gear 3. A positioning spring 64 of torsion spring type is connected between the arm body 61 of the second driven component 6. The positioning spring 64 can elastically twist into the shape shown in FIG. 4 after the second driven component 6 rotates in the forward direction, and can elastically twist into the shape shown in FIG. 3 after the second driven component 6 rotates in the reverse direction. The positioning spring 64 can thus position the second driven component 6 after twisting. A hung body 52 to be used as the basis for elastically restoring the first driven component 5 projects downwards from the lower end of the pivotal position of the first driven component 5.

Figure 6:
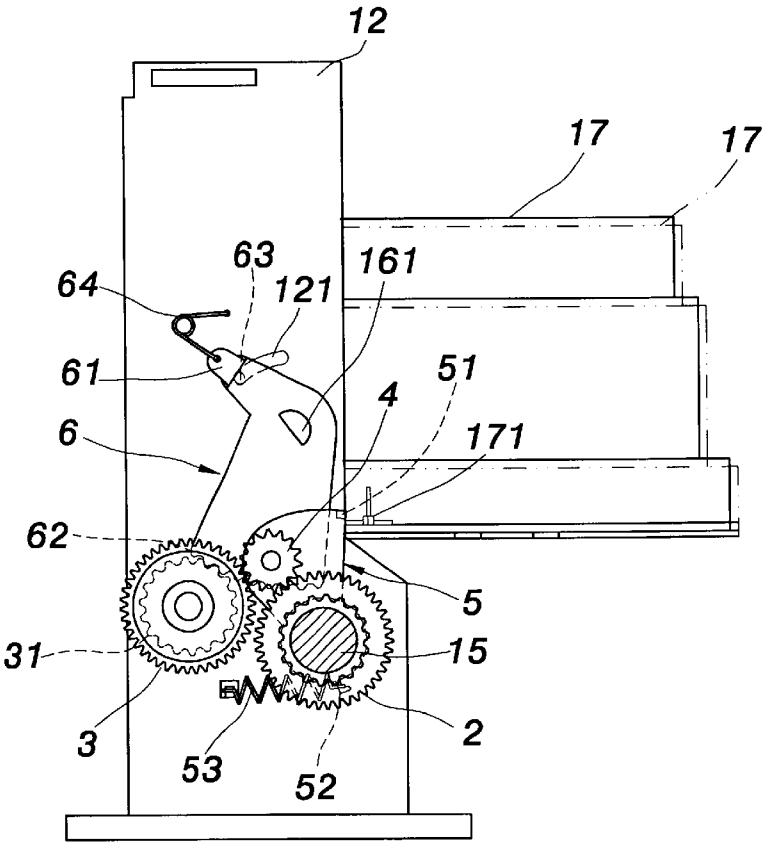
FIG. 6 is a partly left side view after action according to another embodiment of the present invention.
Figure 5:
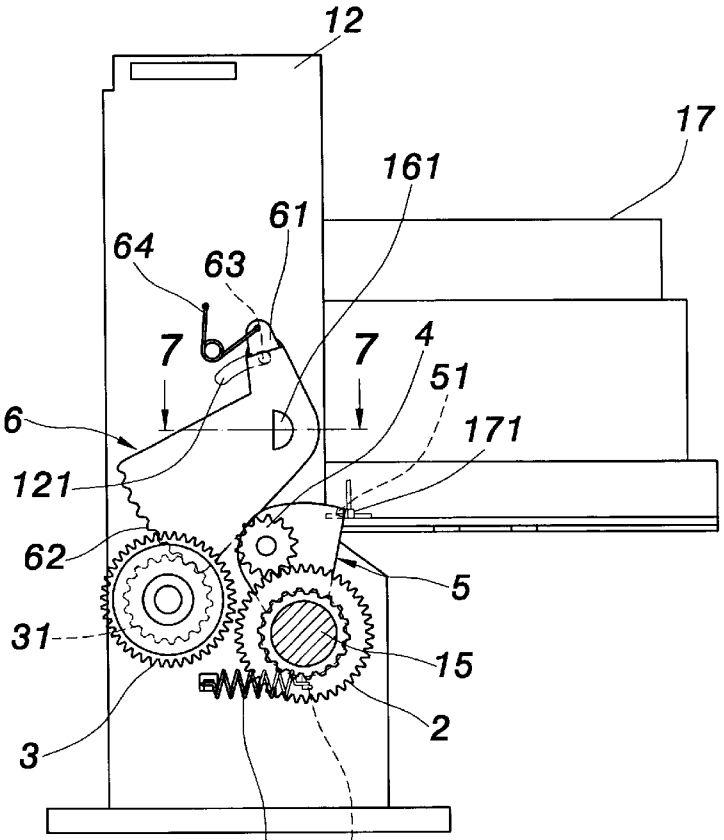
FIG. 5 is a partly left side view before action according to another embodiment of the present invention.

As shown in FIG. 1, the print cartridge receiving seat 17 is located at the print region and can perform printing action. When different kinds of papers are placed in a paper feeding-in case (not shown) of a printer, a sensor (not shown) disposed at the paper feeding-in case can detect the kind of paper (this technique is well known in the prior art). Through a command issued from an internal circuit, the print cartridge receiving seat of the printer is controlled to transversely move to the utmost side shown in FIG. 2, and the driven body 51 of the first driven component 5 is touched by the driving component 171. As shown in FIGS. 3 and 4, the first driven component 5 is driven-by the driving component 171 to move rearwards, and leads the third gear 4 to further engage and drive the second gear 3 to rotate. At this time, the gear set engages each other. Through rotation of the second gear 3, the lift unit is synchronously driven to make lift/drop action. That is, through different rotation directions of the paper feed drive motor 14, the coaxial gear 31 of the second gear 3 can lead the second driven component 6 of the lift unit to rotate in the forward direction (as shown in FIGS. 3 and 4) or in the reverse direction (as shown in FIGS. 5 and 6), and can synchronously drive the second pivotal rod 16 to make eccentric rotation so as to accomplish the object of lift/drop adjustment. Please refer to FIG. 7 with also reference to FIGS. 3 and 4. Forward rotation of the second driven component 6 can let the protrudent post 63 thereof move from the lower end to the upper end of the trench 121. Simultaneously, the positioning spring 64 can accomplish its twisting and positioning action. Through rotation of the second driven component 6, the second pivotal rod 16 can be simultaneously led to make synchronous eccentric rotation with the eccentric shaft 161 thereof as the axis. The print cartridge receiving seat 17 can thus be synchronously driven to move upwards (or downwards) so as to adjust the spacing between the cartridge of the print cartridge receiving seat 17 and the paper. When a paper of another kind is detected, through the first driven component 5 driven by the driving component 171 and reverse rotation of the paper feed drive component 14, the second driven component 6, the second pivotal rod 16, and the print cartridge receiving seat 17 can the led to restore to their original positions. Therefore, the present invention can directly utilize the existing paper feed drive component 14 to accomplish the object of spacing adjustment without the need of any extra motor.

As shown in FIGS. 5 and 6, the second driven component 6 is indirectly led to rotate in the reverse direction before and after the reverse rotation of the paper feed drive component 14. The protrudent post 63 of the second driven component 6 is thus led to move from the upper end to the lower end of the trench 121, hence leading the print cartridge receiving seat 17 to move upwards (or downwards) for adjustment. Besides, no matter the lift unit is controlled to lift or drop, when the lift/drop action is finished, the print cartridge receiving seat 17 immediately leaves the driven state. Moreover, when the print cartridge receiving seat 17 leaves the utmost side, the first driven component 5 can elastically restore through the elastic component 53 thereof, and the third gear 4 no longer engages the second gear 3.

Of course, it is also feasible that dose not use the above sensor in the present invention for use. Although full automatic spacing adjustment cannot be accomplished, the object of semi-automatic spacing adjustment can be achieved through a preset button pressed or choose from software by users.

To sum up, because the existing paper feed drive motor 14 of the printer is utilized to lead the gear set and the lift unit to perform the actions of spacing adjustment, it is not necessary to add in an extra expensive motor. Therefore, the object of spacing adjustment can be achieved without adding the cost of another motor. Moreover, if a sensor is further matched to detect the kind of paper, the actions of the gear set and the lift unit can be controlled in full automatic way without any manual operation of user. Once a user places in a paper of a different kind, the printer will automatically perform the actions of spacing adjustment through detection of the sensor. Moreover, the actions of spacing adjustment are accomplished with the existing paper feed drive motor of the printer without adding the cost of another motor.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. An automatic spacing adjustment mechanism for a print cartridge receiving seat comprising:

a frame member having an arcuate trench formed therein;

a gear set including a first gear driven responsive to a feed drive motor, a second gear spaced from said first gear, and a third gear engaging said first gear, said third gear being displaceable between engaged and disengaged positions in a manner responsive to a transverse position of the print cartridge receiving seat, said third gear in said engaged position engaging said second gear; and, a lift unit engaged by said second gear for actuation responsive thereto, said lift unit including a pivotal rod supporting said print cartridge receiving seat and a driven component coupled to said pivotal rod, said driven component being guided in displacement between first and second positions by a protruding portion thereof slidably engaging said frame member arcuate trench, said pivotal rod maintaining said print cartridge receiving seat at respective low and high positions responsive to said driven component being disposed in said first and second positions.

2. The automatic spacing adjustment mechanism as claimed in claim 1, wherein a driving component projects from beside said print cartridge receiving seat, and said driving component selectively driving said third gear of said gear set to be in the engaged position.

3. The automatic spacing adjustment mechanism as claimed in claim 1, wherein said pivotal rod is connected at said print cartridge receiving seat to eccentrically lead said print cartridge receiving seat to move upwards or downwards responsive to angular displacement of said driven component.

4. The automatic spacing adjustment mechanism as claimed in claim 1 further comprising a sensor for detecting the kind of a paper to be printed, said sensor sending out a command for controlling said print cartridge receiving seat to move to an utmost side position after detection.

5. The automatic spacing adjustment mechanism as claimed in claim 1, wherein said third gear is pivotally connected to an auxiliary driven component, said auxiliary driven component and said first gear being coaxially connected, said third gear being displaceable with said auxiliary driven component about an axis of said first gear, said auxiliary driven component being displaceable responsive to the transverse position of said print cartridge receiving seat.

6. The automatic spacing adjustment mechanism as claimed in claim 1, wherein said third gear is pivotally connected to an auxiliary driven component, said auxiliary driven component and said first gear being coaxially connected, said third gear being displaceable with said auxiliary driven component about an axis of said first gear.

7. The automatic spacing adjustment mechanism as claimed in claim 6, wherein an elastic component is connected at a lower end of said auxiliary driven component, and the other end of said elastic component is connected at said frame member.

8. The automatic spacing adjustment mechanism as claimed in claim 1, wherein said pivotal rod is connected at said print cartridge receiving seat and has an eccentric shafts, and said driven component is driven by said second gear.

9. The automatic spacing adjustment mechanism as claimed in claim 8, wherein said driven component is fixedly connected at said eccentric shaft of said pivotal rod, a lower end of said driven component having a teeth edge, and said teeth edge engaging a coaxial gear of said second gear.

10. The automatic spacing adjustment mechanism as claimed in claim 8, wherein said eccentric shafts of said pivotal rod is pivotally connected at said frame member, and a positioning spring is connected between an upper end of said driven component and said frame member to bias said driven component to one of said first and second positions thereof.

11. The automatic spacing adjustment mechanism as claimed in claim 10, wherein said positioning spring is a twist spring.

* * * * *